US008752744B2

(12) United States Patent
Okouchi et al.

(10) Patent No.: US 8,752,744 B2
(45) Date of Patent: Jun. 17, 2014

(54) PORTABLE TOOLS

(75) Inventors: Yukiyasu Okouchi, Anjo (JP); Shingo Umemura, Anjo (JP); Takayoshi Yoshimura, Anjo (JP); Jiro Oda, Anjo (JP); Kenichi Miyata, Anjo (JP)

(73) Assignee: Makita Corporation, Anjo (JP)

( * ) Notice: Subject to any disclaimer, the term of this patent is extended or adjusted under 35 U.S.C. 154(b) by 1196 days.

(21) Appl. No.: 12/453,380

(22) Filed: May 8, 2009

(65) Prior Publication Data

US 2009/0278012 A1 Nov. 12, 2009

(30) Foreign Application Priority Data

May 9, 2008 (JP) ..... 2008-123709

(51) Int. Cl.
*A45F 5/00* (2006.01)
*A47G 29/00* (2006.01)
*F16M 11/00* (2006.01)

(52) U.S. Cl.
USPC ..... 224/268; 248/690; 248/691; 248/692

(58) Field of Classification Search
CPC ..... A45F 5/00; A47G 29/00; F16M 11/00
USPC ..... 224/268; 248/690, 691, 692
See application file for complete search history.

(56) References Cited

U.S. PATENT DOCUMENTS

| | | | | |
|---|---|---|---|---|
| 4,101,043 | A * | 7/1978 | Johnson et al. | 215/399 |
| 4,209,157 | A * | 6/1980 | Edmisten | 248/691 |
| 4,372,468 | A * | 2/1983 | Harvey | 224/268 |
| 6,102,264 | A * | 8/2000 | Redzisz | 224/197 |
| 6,179,192 | B1 * | 1/2001 | Weinger et al. | 227/8 |
| 6,199,736 | B1 * | 3/2001 | Musarella et al. | 224/667 |
| 6,557,739 | B1 * | 5/2003 | Pursley et al. | 224/268 |
| 7,306,052 | B2 | 12/2007 | Vahabi-Nejad et al. | |
| 7,314,153 | B2 * | 1/2008 | Musarella et al. | 224/269 |
| 7,490,746 | B2 * | 2/2009 | Sakai et al. | 224/269 |
| 7,628,360 | B2 * | 12/2009 | Anthes et al. | 248/125.8 |
| 2002/0122707 | A1 | 9/2002 | Sakai et al. | |
| 2004/0051025 | A1 * | 3/2004 | Stewart, III | 248/690 |
| 2006/0070761 | A1 | 4/2006 | Vahabi-Nejad et al. | |
| 2006/0137829 | A1 * | 6/2006 | Tran | 157/1.17 |
| 2009/0025515 | A1 * | 1/2009 | Shibata et al. | 81/57.4 |

FOREIGN PATENT DOCUMENTS

| | | |
|---|---|---|
| EP | 1 445 073 A1 | 8/2004 |
| EP | 1 916 068 A2 | 4/2008 |
| JP | U-05-063783 | 8/1993 |
| JP | A-10-15852 | 1/1998 |

(Continued)

OTHER PUBLICATIONS

Oct. 23, 2012 Office Action issued in Japanese Patent Application No. 2008-123709 (with English translation).

*Primary Examiner* — Brian D Nash
*Assistant Examiner* — Derek Battisti
(74) *Attorney, Agent, or Firm* — Oliff PLC

(57) ABSTRACT

The present invention includes a portable tool including a tool body having a handle, a hook including a hook body, and a mounting device. The mounting device enables the hook body to be mounted to the handle with the hook body oriented in any one of a plurality of different directions and positioned at any one of a plurality of different positions along the oriented direction.

3 Claims, 6 Drawing Sheets

(56) References Cited

FOREIGN PATENT DOCUMENTS

| | | | | |
|---|---|---|---|---|
| JP | A-10-015852 | | 1/1998 | |
| JP | 10094975 | * | 4/1998 | ..... B25C 7/00 |
| JP | A-2001-162566 | | 6/2001 | |
| JP | A-2002-127149 | | 5/2002 | |
| JP | EP 1 327 500 | A2 | 7/2003 | |
| JP | A-2006-181709 | | 7/2006 | |
| JP | A-2008-000841 | | 1/2008 | |

* cited by examiner

PORTABLE TOOLS

This application claims priority to Japanese patent application serial number 2008-123709, the contents of which are incorporated herein by reference.

BACKGROUND OF THE INVENTION

1. Field of the Invention

The present invention relates to portable tools, such as hand-held portable tools including motor-driven tools, such as power screwdrivers, power drills and power tackers, and tools of gas combustion type.

2. Description of the Related Art

A known hand-held portable tool has a hook enabling an operator to engage the hook to his or her belt when the tools are not used. In many cases, the hook is disposed at a position proximal to the rear end of a handle, which is grasped by the operator during the operation of the tool, so that the hook does not interfere with the operation of the tool. There has been proposed various improvements in the hoot For example, Japanese Laid-Open Patent Publication No. 10-15852 has proposed to enable a hook to be selectively mounted to a left side or a right side of a handle. Japanese Laid-Open Patent Publication No. 2001-162566 has proposed to enable adjustment of a distance between a hook and a handle by changing the orientation of the hook on one side of the handle. U.S. Pat. No. 7,306,052 teaches a technique of enabling a hook to be stored within and along a portion of a handle.

However, the technique of Japanese Laid-Open Patent Publication No. 10-15852 does not allow changing the distance between the hook and the handle. The technique of Japanese Laid-Open Patent Publication No. 2001-162566 does not allow changing the position of the hook between positions on the left side and the right side of the handle; The technique of U.S. Pat. No. 7,306,052 does not allow changing the distance between the hook and the handle when the hook is positioned on the right side or the left side of the handle.

Therefore, there is a need in the art for portable tools that have hooks and are improved in operability.

SUMMARY OF THE INVENTION

One aspect according to the present invention includes a portable tool including a tool body having a handle, a hook including a hook body, and a mounting device. The mounting device enables the hook body to be mounted to the handle with the hook body oriented in any one of a plurality of different directions and with the hook body positioned at any one of a plurality of different positions along the oriented direction.

DETAILED DESCRIPTION OF THE INVENTION

Each of the additional features and teachings disclosed above and below may be utilized separately or in conjunction with other features and teachings to provide improved portable tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
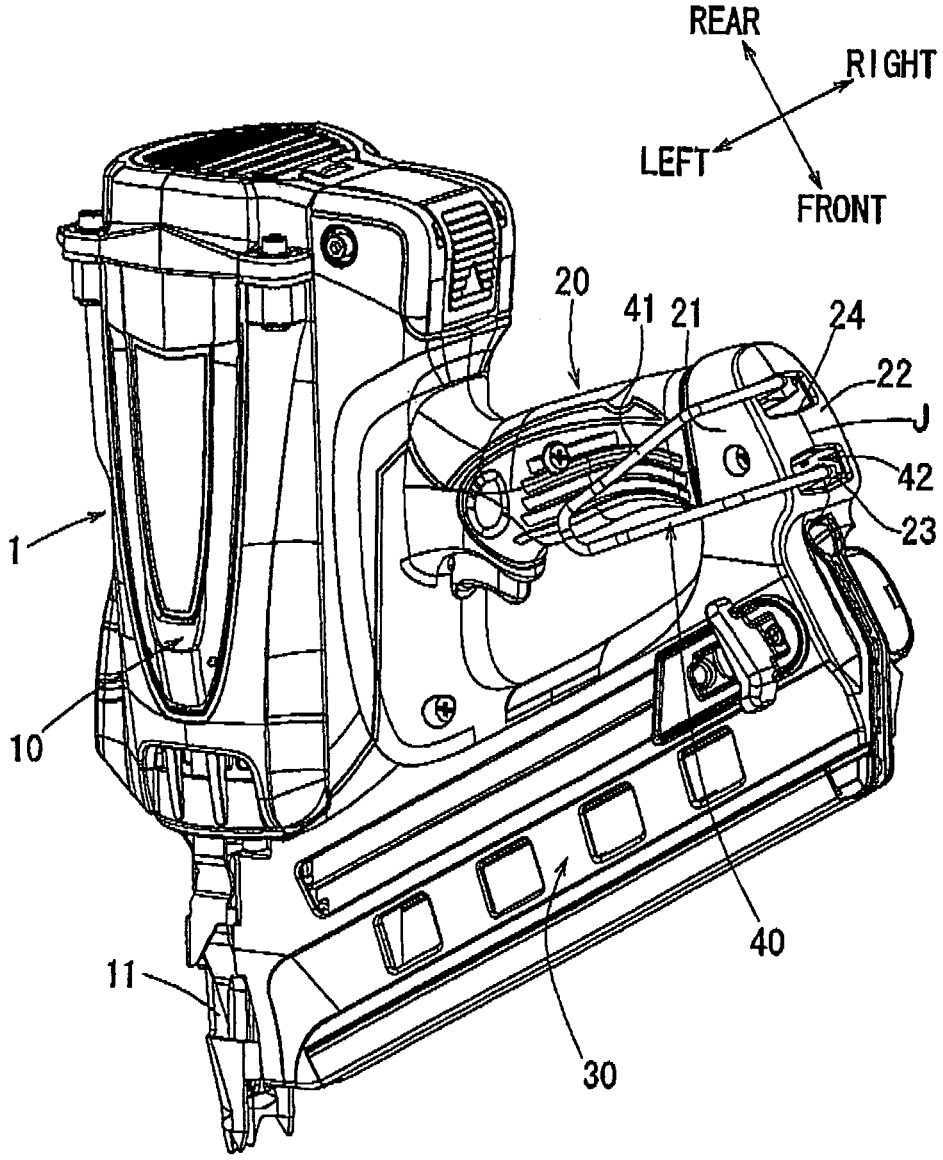
FIG. 1 is a perspective view of a portable tool according to an embodiment of the present invention.

An embodiment of the present invention will now be described with reference to FIGS. 1 to 6. Referring to FIG. 1, there is shown an entire portable tool 1 configured as a nailer of gas combustion type. In the following explanation, a position of a person who may grasp the handle 20 will be taken as a reference of right and left directions, forward and rearward directions and upward and downward directions.

The portable tool 1 has a tool body 10 and a handle 20. A hook 40 has hook holder 42 mounted to a lower end (right end as viewed in FIG. 1) of the handle 20. A driver guide 11 is mounted to a front portion of the tool body 10 and extends forwardly therefrom. A magazine 30 is mounted to the driver guide 11 and a lower portion of the handle 20 and extends therebetween. Nails (not shown) are stored within the magazine 30 and can be supplied one by one into the driver guide 11 in response to the driving operation of the tool body 10, so that the nails can be driven out of the front end of the driver guide 11. More specifically, although not shown in the drawings, the tool body 10 has a piston that is reciprocally movable within a cylinder and can be driven to move forwardly by the pressure of a combusted gas, so that a driver attached to the piston can move forwardly within the driver guide for driving the nail.

The handle 20 is mounted to a lower side of the tool body 10 and extends downwardly therefrom. Each of the tool body 10 and the handle 20 has right and left housing halves. More specifically, the handle 20 has a pair of right and left handle housings halves 21 and 22 that are in contact with each other and are joined at a joint plane J to configure a handle housing that can be easily grasped by an operator. The hook 40 has a hook body 41 and is positioned on the left side of the handle 20 in FIG. 1.

Figure 2:
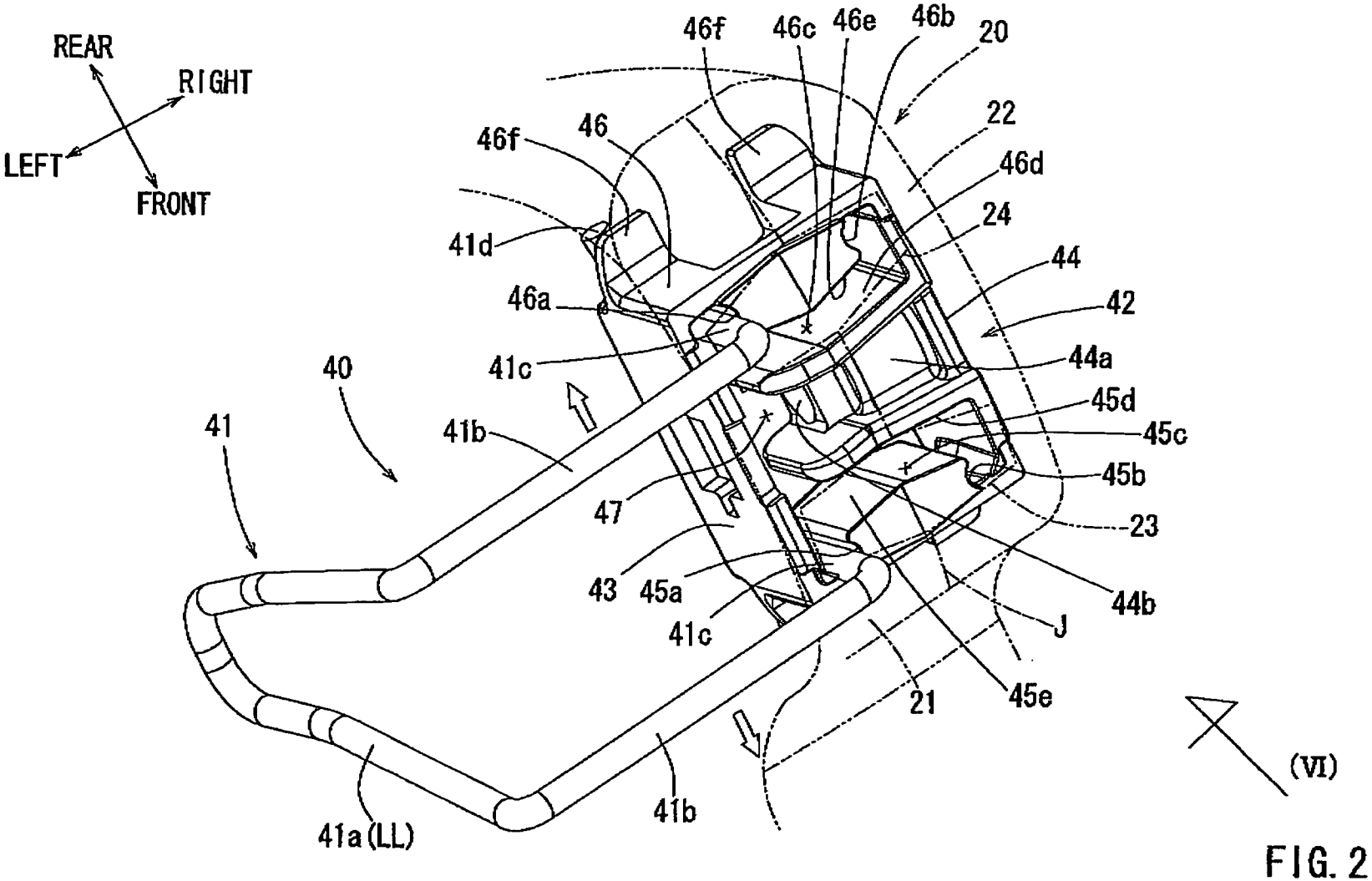
FIG. 2 is a perspective view of a hook having a hook body and a hook holder mounted to a lower end of a handle of the portable tool and showing the state where the hook body is positioned at a left large distance position.
Figure 3:
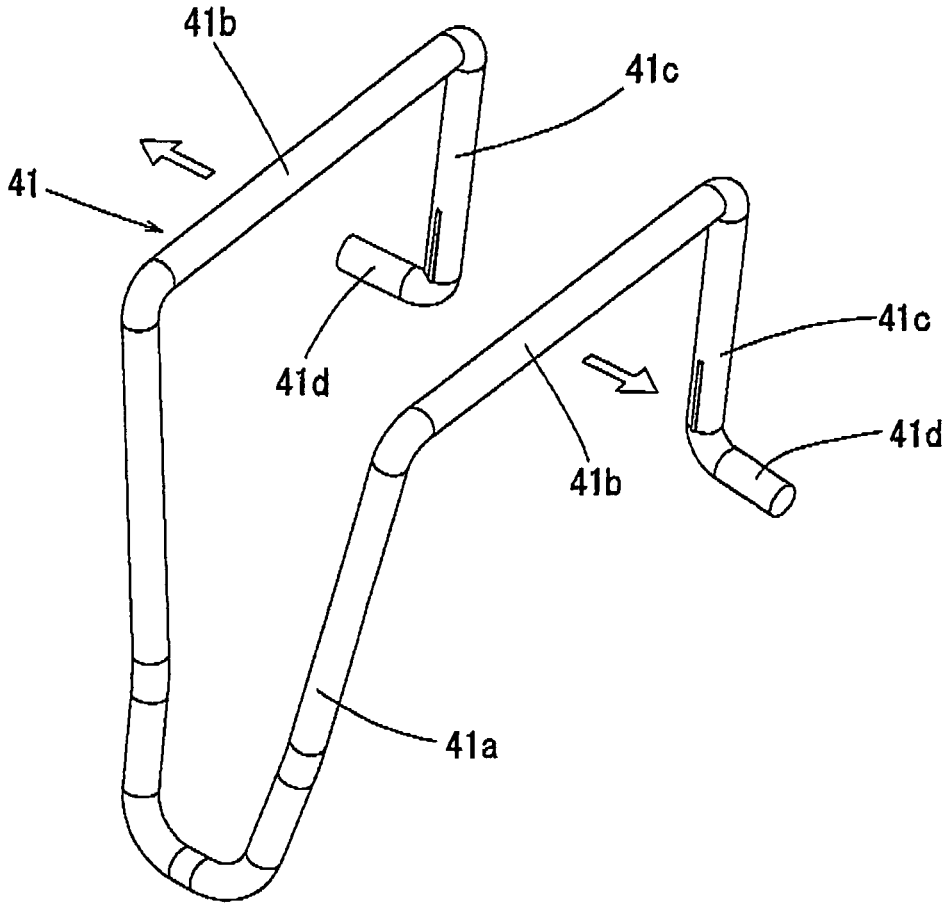
FIG. 3 is a perspective view of the hook body.

The hook 40 has the hook body 41 and the hook holder 42 for holding the hook body 41 against the handle 20. As shown in FIG. 2, the hook holder 42 is fixed and clamped between the handle housing halves 21 and 22 of the handle 20. The hook body 41 is shown separately in FIG. 3, and the hook holder 42 is shown separately in FIG. 4.

The hook body 41 is formed by a single steel wire and is bent in a form of U-shape, so that the hook body 41 has resiliency. The hook body 41 has a U-shaped hook portion

41*a*, a pair of extension arms 41*b* extending rightwardly from the hook portion 41*a*, and a pair of support legs 41*c* extending rightwardly from the respective extension arms 41*b*. More specifically, the extension arms 41*b* extend in parallel to each other and substantially perpendicular to the opposite end portions of the hook portion 41*a* The support legs 41*c* extend substantially perpendicular to the end portions of the extension arms 41*b* on the side opposite to the hook portion 41*a* and substantially in parallel to the hook portion 41*a*. The end portions of the support legs 41*c* on the side opposite to the extension arms 41*b* are bent in directions away from each other to form engaging portions 41*d*.

Figure 4:
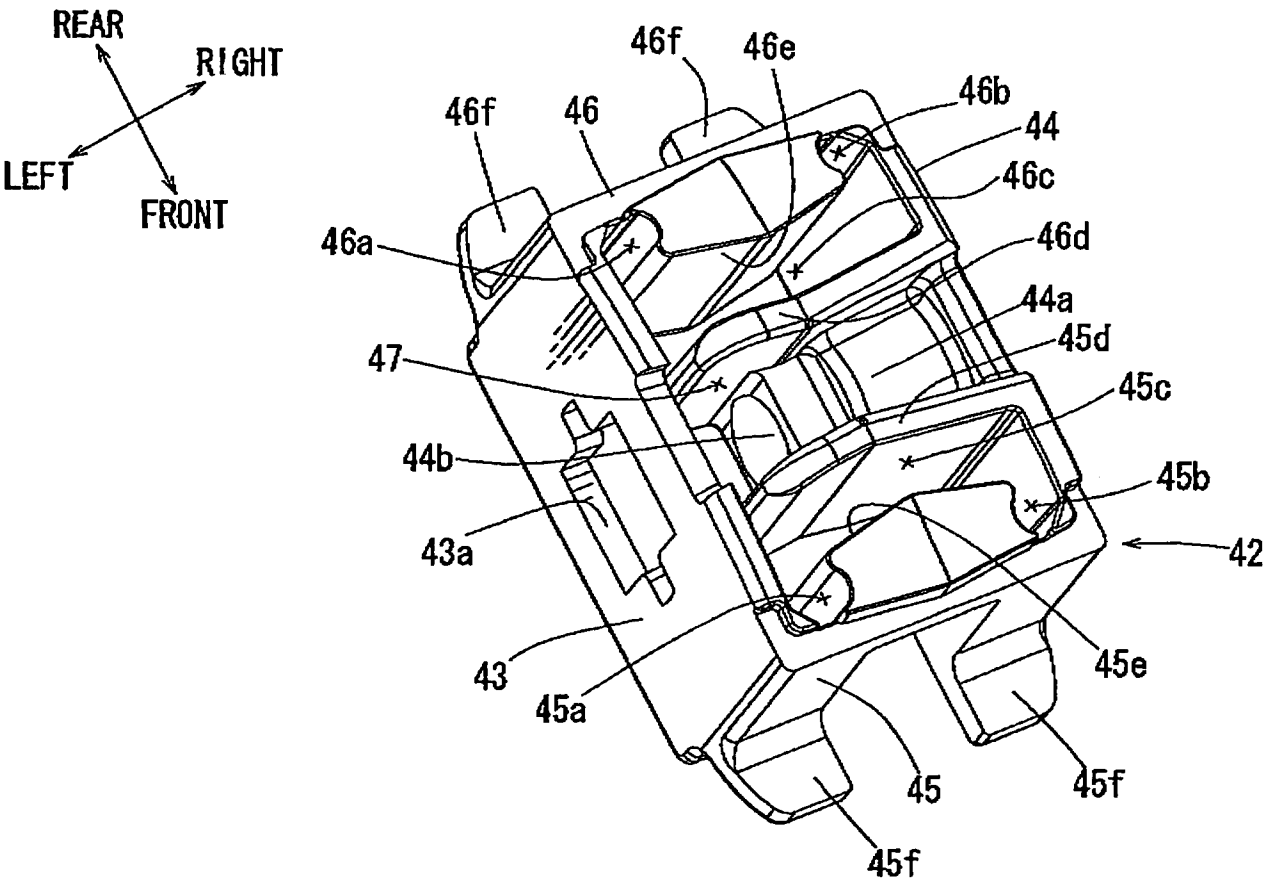
FIG. 4 is a perspective view of the hook holder.

Because the hook portion 41*a* has a U-shape and has resiliency in open and close directions of the U-shape, the hook body 41 may have resiliency as a whole in such directions that the extension arms 41*b* are shifted toward and away from each other (e.g., the directions indicated by outline arrows in FIGS. 2 and 4). Therefore, the operator can move the extension arms 41*b* toward each other against the resiliency by pinching the extension arms 41*b* with his or her fingers. In other words, the extension arms 41*b* can be closed by forcibly moving the extension arms 41*b* toward each other against the biasing force. By closing the extension arms 41*b*, the support legs 41*c* are also closed or moved toward each other, and further, the engaging portions 41*d* are also closed or moved toward each other. Thus, in this embodiment, the support legs 41*c* can be moved toward each other as the extension arms 41*b* move toward each other. In addition, by moving the extension arms 41*b* toward each other, it is possible to change the position of the hook body 41 or to remove the hook body 41 from the hook holder 42 as will be explained later.

The hook holder 42 has a frame-like configuration and formed into one piece with four side walls 43, 44, 45 and 46. More specifically, the hook holder 42 has left and right side walls 43 and 44 opposed to each other and also has front and rear side walls 45 and 46 opposed to each other. A rectangular insertion hole 43*a* is formed in the central portion of the left side wall 43. A boss portion 44*a* is formed on the central portion of the inner side of the right side wall 44 at a position opposed to the insertion hole 43*a*. An insertion hole 44*b* is formed to extend along the central axis of the boss portion 44*a*. The insertion holes 43*a* and 44*b* extend along the same axis. The handle housing halves 21 and 22 have inner wall surfaces having boss portions (not shown) that are substantially closely fitted into the insertions holes 43*a* and 44*b*, respectively. Screw insertion holes are formed in the boss portions of the handle housing halves 21 and 22, so that a fixing screw can be inserted into the screw insertion holes. With the hook holder 42 positioned between the handle housing halves 21 and 22 and with the handle housing halves 21 and 22 contacting with each other at the joint plane J, the fixing screw is inserted into the screw insertion holes and is engaged with a nut or an internal thread formed in one of the screw insertion holes. Then, the fixing screw is tightened, so that the handle housing halves 21 and 22 are connected to each other, and at the same time, the hook holder 42 is clamped and fixed between the handle housing halves 21 and 22. In this way, the hook holder 42 can be fixedly mounted within the lower end portion of the handle 20.

Support holes 45*a* and 45*b* are formed in the front side wall 45 and are positioned at the right side end and left side end of the front side wall 45, respectively. Similarly, support holes 46*a* and 46*b* are formed in the rear side wall 46 and are positioned at the right side end and the left side end of the rear side wall 46, respectively. The support holes 45*a*, 45*b*, 46*a* and 46*b* extend parallel to each other and have a width capable of substantially closely receiving the support legs 41*b* of the hook body 41. The hook body 41 can be mounted to the hook holder 42 to extend leftward or rightward from the hook holder 42 with one of the support legs 41*c* supported within the front side support hole 45*a* (or 45*b*), and with the other of the support legs 41*c* supported within the rear side support hole 46*a* (or 46*b*).

The front side support holes 45*a* and 45*b* communicate with each other in right and left directions via a connecting recess 45*c*. The rear side support holes 46*a* and 46*b* communicate with each other in right and left directions via a connecting recess 46*c*, The front side of the front side connecting recess 45*c* is delimited by a guide wall 45*e*, and the rear side of the front side connecting recess 45*c* is delimited by a support wall 45*d*. Similarly, the front side of the rear side connecting recess 46*c* is delimited by a support wall 46*d*, and the rear side of the rear side connecting recess 46*c* is delimited by a guide wall 46*e*. The boss portion 44*a* is positioned between the support walls 45*d* and 46*d*.

One of the support legs 41*c* of the hook body 41 can move between the left and right support holes 45*a* and 45*b* via the front side connecting recess 45*c*. The other of the support legs 41*c* can move between the left and right support holes 46*a* and 46*b* via the rear side connecting recess 46*c*.

The front side guide wall 45*e* is formed to have an angle shape that is inclined rearwardly from a central ridge with respect to the right and left directions. Similarly, the rear side guide wall 46*e* is formed to have an angle shape that is inclined forwardly from a central ridge with respect to the right and left directions. When the support legs 41*e* of the hook body 41 are resiliently pressed against the guide walls 45*e* and 46*e*, respectively, the support legs 41*c* are guided to move into the left support holes 45*a* and 46*a* or the right support holes 45*b* and 46*b* due to the inclination of the guide walls 45*e* and 46*e*. Therefore, the support legs 41*c* can be prevented from stopping at midpoints of the corresponding connecting recesses 45*c* and 46*c*, respectively, so that the support legs 41*c* can be held in stable within the left support holes 45*a* and 46*a* or within the right support holes 45*b* and 46*b*.

Further, because the guide walls 45*e* and 46*e* of the connecting recesses 45*c* and 46*c* are angled to have central ridges and the support legs 41*c* are resiliently pressed against the guide walls 45*e* and 46*e*, the support legs 41*c* can be prevented from being removed from the support holes 45*a* and 46*e* (or the support holes 45*b* and 46*b*). Thus, once the support legs 41*c* are held within the support holes 45*a* and 46*a* (or the support holes 45*b* and 46*b*), the support legs 41*c* are prevented from being removed even in the case that vibrations are applied to the portable tool. Therefore, the hook body 41 can be mounted in stable.

Further, the support walls 45*d* and 46*d* extend from the right side wall 44 and terminate at a position before reaching the left side wall 43. With this arrangement, a removing recess 47 for facilitating the removal of the hook body 41 is formed to extend in forward and rearward directions along the left side wall 43 and communicates between the left front side support hole 45*a* and the left rear side support hole 46*a*. Thus, in order to remove the hook body 41, the operator pinches the extension arms 41*b* to move the support legs 41*c* toward each other against the resilient biasing forces, so that the support legs 41*c* enter the removing recess 47, where it is possible to move the support legs 41*c* further toward each other.

Contact walls 45*f* are formed on the front side wall 45 at positions proximal to the lower ends of the support holes 45*a* and 45*b* and extend forwardly therefrom, respectively. Similarly, contact walls 46*f* are formed on the rear side wall 46 at positions proximal to the lower ends of the support holes 46*a* and 46*b* and extend rearwardly therefrom, respectively.

The engaging portions 41*d* of the hook body 41 can engage the contact walls 45*f* or 46*f* from the backside or the lower side (i.e., backside of the sheet of FIG. 2) of the hook holder 42, so that the hook body 41 can be prevented from being removed in a removing direction (i.e., a direction on the front side of the sheet of FIG. 2 or FIG. 4) from the hook holder 42.

As described previously, in order to remove the hook body 41, the operator pinches the extension arms 41*b* with his or her fingers to move the support legs 41*c* toward each other against the biasing forces, so that the support legs 41*c* enter the removing recess 47, where it is possible to move the support legs 41*c* further toward each other. As the support legs 41*c* are positioned close to each other after entering the removing recess 47, the engaging portions 41*d* are moved not to oppose to the contact walls 45*f* and 46*f* but to oppose to the support holes 45*a* and 46*a*. In this state, the engaging portions 41*d* and the support legs 41*c* can be removed upwardly from the support holes 45*a* and 46*a*, so that the hook body 41 can be removed from the hook holder 42.

In this way, by using the removing recess 47 disposed at the left side portion of the hook holder 42, the hook body 41 can be removed from the hook holder 42. The hook body 41 can be mounted to the hook holder 42 also by using the removing recess 47. Thus, in order to mount the hook body 41 to the hook holder 42, the hook body 41 is oriented rightward or leftward, and the support legs 41*c* are then positioned within the removing recess 47. Thereafter, the operator releases the support legs 41*c*, so that the support legs 41*c* resiliently restore to move away from each other. Hence, the support legs 41*c* enter the corresponding support holes 45*a* and 46*a*. As a result, the hook body 41 can be mounted such that the hook body 41 is positioned on either the left side or the right side of the handle 20.

The hook holder 42 constructed as described above is fixedly mounted within the lower end of the handle 20 as shown in FIGS. 1 and 2. More specifically, front and rear openings 23 and 24 are formed in the lower end of the handle 20. The front and rear openings 23 and 24 are spaced from each other in the forward and rearward directions and each extends between the left and right handle housing halves 21 and 22 across the joint plane J.

The front connecting recess 45*c* and the front left and right side support holes 45*a* and 45*b* of the hook holder 42 are open to the outside of the handle 20 via the front opening 23. Similarly, the rear connecting recess 46*c* and the rear left and right side support holes 46*a* and 46*b* are open to the outside of the handle 20 via the rear opening 24. The width of each of the openings 23 and 24 in the forward and rearward directions is set to be sufficient for the function of the removing recess 47.

According to the portable tool 1 of the above embodiment, the hook 40 is disposed at the lower end of the handle 20. By using the hook 40, the operator can hook the portable tool 1 to a waste belt that he or she wears or to a foot holding base of a stepladder when the portable tool 1 is not used. Therefore, it is possible to easily handle the portable tool 1 and the operator can efficiently perform various works by using the portable tool 1.

Further, according to the hook 40 of this embodiment, the mounting position of the hook body 41 can be changed between the left side and the right side of the handle 20. In addition, depending on an object, to which the hook 40 is hooked, it is possible to change the distance between the hook portion 41*a* and the left or right side surface of the handle 20 between a small distance and a large distance in either case that the hook body 41 is positioned on the left side or the right side of the handle 20.

Figure 6:
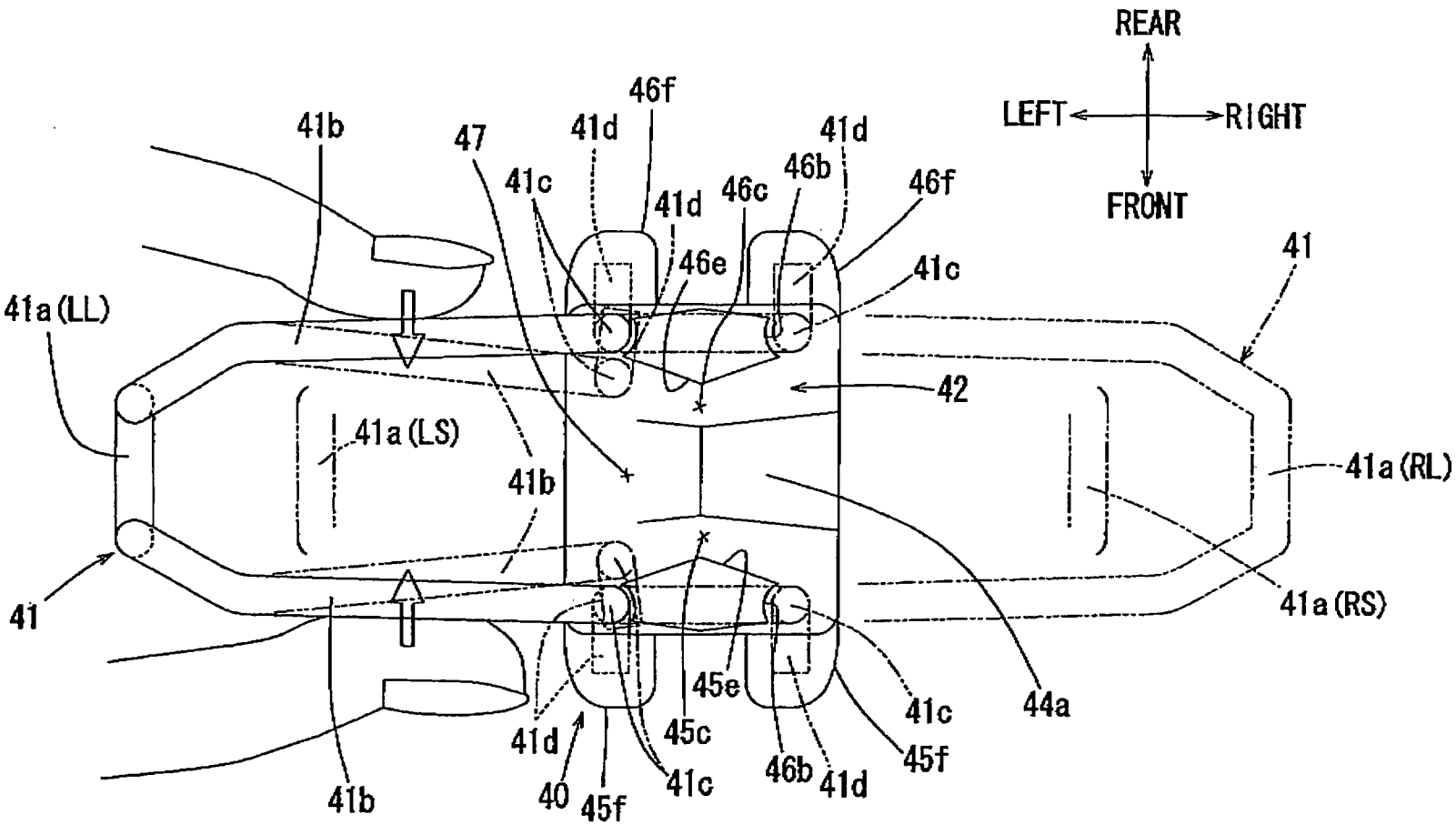
FIG. 6 is a view as viewed in a direction of arrow (6) in FIG. 2 and shown a left large distance position of the hook body by solid lines, and showing the left small distance position, a right large distance position and a right small distance position of the hook body by chain lines.

In FIG. 6, the hook body 4 mounted to the left side of the handle 20 is indicated by solid lines, while the hook body 41 mounted to the right side of the handle 20 is indicated by chain lines. In FIG. 6, the hook portion 41*a* of the hook body 41 indicated by solid lines is positioned at a large distance position spaced from the left side surface (not shown in FIG. 6) of the handle 20 by a large distance and is labeled with an additional reference sign (LL). FIGS. 1 and 2 show the hook body 41 mounted to the left side of the handle 20 at the large distance position.

When the hook body 41 is mounted to the left side at the large distance position (hereinafter called "left large distance position"), the hook portion 41*a* of the hook body 41 is spaced by a large distance from the left side surface of the handle 20. Therefore, the left large distance position is suitably used, for example, in the case that the portable tool 1 is hooked to a relatively thick member, such as a foot holding base of a stepladder and a two-by-four material. The mounting position of the hook body 41 can be changed from the left large distance position to a small distance position on the left side of the handle 20 (hereinafter called "left small distance position").

In order to change the mounting position of the hook body 41 from the left large distance position to the left small distance position, it is not necessary to remove the hook body 41 from the hook holder 42 or the handle 20. Thus, the operator first pinches the extension arms 41*b* of the hook body 41 with his or her fingers to move the extension arms 41*b* toward each other against the resilient forces of the extension arms 41*b* as indicated by outline arrows in FIG. 6. As the extension arms 41*b* move toward each other to positions indicated by chain lines in FIG. 6, the support legs 41C also move toward each other so as to be removed from the support holes 45*a* and 46*b* and moved into the connective recesses 45*c* and 46*c*. In addition, because the distance between the support legs 41*c* becomes smaller, the engaging portions 41*d* formed on the lower sides of the support legs 41*c* move from positions opposed to the backsides of the corresponding contact walls 45*f* and 46*f* of the hook holder 42 to positions within the support holes 45*a* and 46*a* or within the connecting recesses 45*c* and 46*c*.

Figure 5:
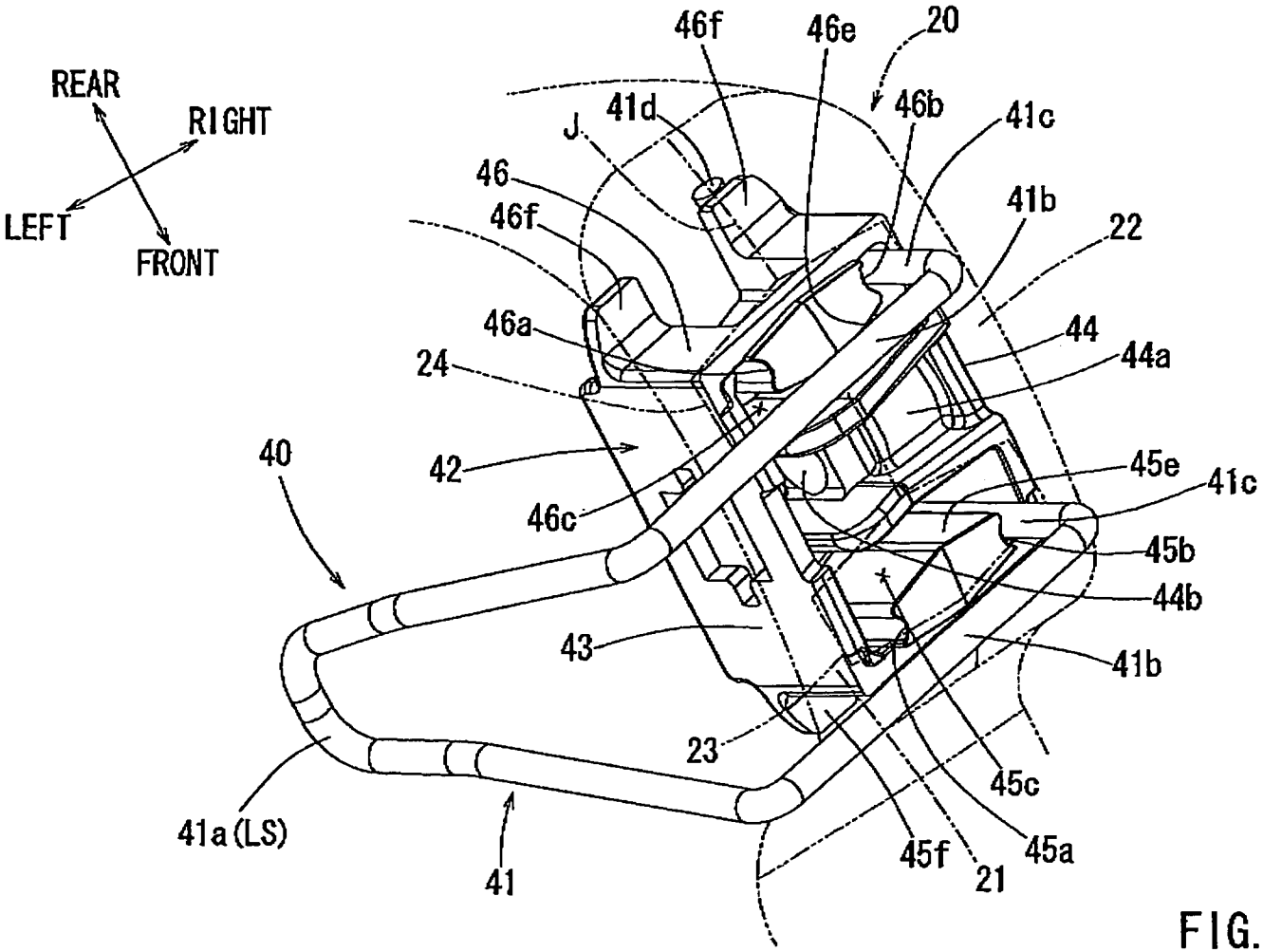
FIG. 5 is a perspective view of the hook and showing the state where the hook body is positioned at a left small distance position.

As the engaging portions 45*a* and 46*a* move away from the contact walls 45*f* and 46*f*, the support legs 41*c* can move leftward or rightward within the connecting recesses 45*c* and 46*c*, so that the hook body 41 can be moved leftward or rightward. For example, when the hook body 41 is moved rightward from the left large distance position indicated by solid lines in FIG. 6, the distance between the hook portion 41*a* of the hook body 41 and the left side surface of the handle 20 becomes smaller. When the hook body 41 reaches the left small distance position, the operator releases the extension arms 41*b*, so that the extension arms 41*b* move away from each other. Then, the support legs 41*b* are fitted into the support holes 45*b* and 46*b* positioned on the right side, and the engaging portions 41*d* are brought to contact the backsides of the contact walls 45*f* and 46*f* positioned on the right side. The hook body 41 can be held in stable at the left small distance position because the support legs 41*c* are pressed against the inner surfaces of the support holes 45*b* and 46*b* by the resilient forces of the support legs 41*c*. FIG. 5 shows the state where the hook body 41 is held at the left small distance position.

In this way, the distance between the hook portion 41*a* and the left side surface of the handle 20 becomes smaller as the hook body 41 moves from the left large distance position to the left small distance position. The left small distance position is suitably used when the hook body 41 is hooked to a relatively thin member, such as a waist belt of the operator. In FIGS. 5 and 6, the hook portion 41*a* of the hook body 41 positioned at the left small distance positioned is labeled with an additional reference sign (LS).

As described above, the hook body 41 can be mounted such that the hook body 41 is positioned at any one of two leftwardly extending positions including the left large distance position and the left small distance position. It is also possible to mount the hook body 41 on the right side of the handle 20. In order to change the position of the hook body 41 from the left large distance position to the right side of the handle 20, the operator pinches the extension arms 41*b* with his or her fingers to move them toward each other against the resilient forces, so that the support legs 41*c* move from the support holes 45*a* and 46*b* into the removing recess 47. As the support legs 41*c* move close to each other, the engaging portions 41*d* move into the removing recess 47 away from positions opposed to the backsides of the contact walls 45*f* and 46*f*. Thereafter, the support legs 41*c* and the engaging portions 41*d* can be removed from the removing recess 47 and further from the openings 23 and 24. Hence, the book body 41 can be removed from the hook holder 42.

The removed hook body 41 is then reversed with respect to the left and right directions, and the operator again pinches the extension arms 41*b* to move them toward each other against the biasing forces. With the extension arms 41*b* held to be close to each other, the operator inserts the support legs 41*c* into the removing recess 47 via the openings 23 and 24. Thereafter, the operator releases the extension arms 41*b*, so that the support legs 41*c* enter the support holes 45*a* and 46*b* and the engaging portions 41*d* engage the backsides of the contact walls 45*f* and 46*f*. As a result, the hook body 41 can be mounted at a small distance position that is spaced from the right side surface of the handle 20 by a small distance. This position will be hereinafter called "right small distance position", and the hook portion 41*a* of the hook body 41 positioned at the right small distance position is labeled with an additional reference sign (RS) in FIG. 6.

Also, the mounting position of the hook body 41 can be changed from the right small distance position to a large distance position that is spaced from the right side surface of the handle 20 by a large distance (hereinafter called "right large distance position") in the same manner as discussed in connection with the left small and large distance positions. Thus, the operator first pinches the extension arms 41*b* of the hook body 41 with his or her fingers to move the extension arms 41*b* toward each other against the resilient forces of the extension arms 41*b*. Then, the operator moves the hook body 41 rightward to move the support legs 41*c* along and within the connecting recesses 45*c* and 46*c*. This operation can be made while the support legs 41*c* slidably contact with the corresponding guide walls 45*e* and 46*d* by the biasing forces of the extension arms 41*b*. When the hook body 41 reaches the right large distance position, the support legs 41*b* are fitted into the support holes 45*b* and 46*b* positioned on the right side, and the engaging portions 41*d* are brought to engage the backsides of the contact walls 45*f* and 46*f* positioned on the right side. In FIG. 6, the hook portion 41*a* of the hook body 41 positioned at the right large distance position is labeled with an additional reference sign (RL).

Therefore, similar to the case that the hook body 41 is mounted on the left side of the handle 20, the right large distance position (RL) can be used for hooking the hook body 41 to a foot holding base of a stepladder and a two-by-four material, and the right small distance position (RS) can be used for hooking the hook body 41 to a waste belt worn by the operator.

As described above, according to the above embodiment, the orientation of the hook body 41 relative to the lower end of the handle 20 can be easily changed between the left side position and the right side position. In addition, in each of the left and right side positions, the distance between the hook portion 41*a* and the corresponding side surface of the handle 20 can be changed between the small distance and the large distance.

Therefore, the operator can use the hook 40 by positioning the hook body 41 at the right side position or the left side position depending on the operator's dominant arm. In addition, the distance between the hook portion 41*a* and the corresponding side surface of the handle 20 can be changed between two different distances depending on a portion or a member, to which the hook portion 41*a* is hooked. As a result, the operability of the hook 40 can be improved.

In addition, because the hook body 41 is held in these positions by using the resiliency of the hook body 41, it is possible to easily directly mount the hook body 41 to the hook holder 42 without use of fixing screws or the like.

The above embodiment can be modified in various ways. For example, although the hook holder 42 is formed as a separate member from the handle housing halves 21 and 22, the hook holder 42 may be formed integrally with one or both of the handle housing halves 21 and 22. For example, the hook holder 42 may include a left holder half and a right holder half that are formed integrally with the left handle housing half 21 and the right handle housing half 22, respectively, and are joined to each other at the joint plane J. Alternatively, the entire hook holder 42 may be formed integrally with one of the handle housing halves 21 and 22.

Further, although the guide wall 45*e* and the guide wall 46*e* delimiting the front side of the connecting recess 45*c* and the rear side of the connecting recess 46*c*, respectively, are each angled to have the central ridge with respect the left and right directions and the inclined surfaces on opposite sides of the central ridge, the guide walls 45*e* and 46*e* may be configured as flat surfaces similar to the support walls 45*d* and 46*d* opposed thereto, respectively.

Furthermore, although the removing recess 47 is formed in the left side portion of the hook holder 42 for enabling the support legs 41*c* positioned on the left large distance position (LL) or the right small distance position (RS) to be directly removed by pinching the extension arms 41*b*, the removing recess 47 can be formed in the right side portion of the hook holder 42, so that the support legs 41*c* positioned on the left small distance position (LS) or the right large distance position (RL) can be directly removed by pinching the extension arms 41*b*. Alternatively, an additional removing recess may be formed in the right side portion of the hook holder 42, so that the hook body 41 can be directly removed from the hook holder 42 in either cases that the support legs 41*c* are positioned on the left side or the right side. With this arrangement, it is also possible to directly mount the hook body 41 at either the left side position or the right side position.

Furthermore, although the nailer of gas combustion type has been described as an example of the portable tool, the present invention can be also applied to pneumatically driven nailers or motor driven nailers. In addition, the present invention may be also applied to screwdrivers and drills or any other portable tools other than the nailers.

This invention claims:

1. A portable tool comprising:

a tool body having a handle; and a hook including:

a hook holder disposed at the handle, and a hook body that (i) is attachable to the hook holder so as to be positioned on any one of two opposite sides with respect to the handle, and a distance between the hook body and the handle can be changed in each of the case that the hook body is positioned on one of the two opposite sides and the case that the hook body is positioned on the other of the two opposite sides, (ii) includes a pair of support legs and has resiliency in opening and closing directions of the support legs, (iii) is attachable to the hook holder with the support legs opened to resiliently engage the hook holder, (iv) is removable from the hook holder when the support legs are closed against a resilient force, wherein:

the hook holder includes (v) two pairs of support holes, each pair of the support holes being able to receive the support legs when the support legs are closed against the resilient force, and each pair of the support holes includes a right support hole and a left support hole positioned on a right side and a left side, respectively, with respect to a distance changing direction of the hook body, and (vi) two pairs of guide walls each pair separating either the right support holes from each other or the left support holes from each other, each guide wall facing a connecting recess that is connected to a corresponding pair of the support holes, each guide wall including an inclined surface that is angled toward a corresponding one of the support holes such that, when a support leg is in the connecting recess, the resilient force of the hook body causes the support legs to be guided along the guide wall into engagement with the corresponding support hole, the support legs can resiliently engage circumferential edges of the support holes when the hook body resiliently recovers to open the support legs, and the support legs can be selectively inserted into either of the two pairs of support holes, so that the orientation of the hook body relative to the handle and the distance between the hook body and the handle can be selectively changed.

2. The portable tool of claim 1, wherein:

the right support holes are connected to each other via a first connecting recess, the left support holes are connected to each other via a second connecting recess, the first and second connecting recesses permit passage of the support legs when the support legs are closed, and the first and second connecting recesses do not permit passage of the support legs when the support legs are opened.

3. The portable tool of claim 2, wherein the handle includes a pair of handle housing halves that are joined to each other, and the hook holder is clamped between the pair of handle housing halves.

* * * * *